United States Patent [19]

Norton

[11] 4,353,194

[45] Oct. 12, 1982

[54] METHOD OF STRAIGHTENING AND REINFORCING STRUCTURAL MEMBERS

[76] Inventor: Willard S. Norton, 5608 NE. Oaktree La., Kansas City, Mo. 64118

[21] Appl. No.: 188,936

[22] Filed: Sep. 19, 1980

[51] Int. Cl.[3] ..... E04G 23/02; E04D 37/00

[52] U.S. Cl. ..... 52/742; 52/169.6; 52/293; 52/514; 52/743; 52/744

[58] Field of Search ..... 52/169.6, 514, 744, 52/743, 741, 439, 293, 300, 127, 303, 100

[56] References Cited

U.S. PATENT DOCUMENTS

| | | | |
|---|---|---|---|
| 377,940 | 2/1888 | Hevner | 52/514 |
| 889,870 | 6/1908 | Chiodo . | |
| 932,261 | 8/1909 | Flynn . | |
| 2,128,480 | 8/1938 | Wertz | 72/71 |
| 2,417,026 | 3/1947 | Walter | 72/127 |
| 2,815,656 | 12/1957 | Klein et al. | 72/16 |
| 3,537,220 | 11/1970 | Ellis | 52/293 |
| 3,768,225 | 10/1973 | Sloan | 52/743 |
| 3,788,017 | 1/1974 | Bachus | 52/127 |
| 4,021,905 | 5/1977 | Benton et al. | 29/401 R |
| 4,024,688 | 5/1977 | Calini | 52/741 |
| 4,189,891 | 2/1980 | Johnson et al. | 52/742 |

*Primary Examiner*—Alfred C. Perham
*Assistant Examiner*—Michael Safavi
*Attorney, Agent, or Firm*—Litman, Day and McMahon

[57] ABSTRACT

A method of straightening and reinforcing a structural member having first and second block members, each of the block members having a passage therethrough aligned with the passage of the other block member and each of the first and second block members having an inner wall displaying a face comprising a part of a surface of the structural member. The method includes the steps of exerting a force against the structural member surface whereby the structural member is moved into a straightened position, removing a section of the inner wall of one of said block members whereby an opening is formed from the structural member surface into the passage of the one block member, placing a reinforcing member in each of the block member passages, connecting the reinforcing members and securing the reinforcing members to the block members by placing grout material within the passages of the first and second block members.

13 Claims, 6 Drawing Figures

Fig. 4.
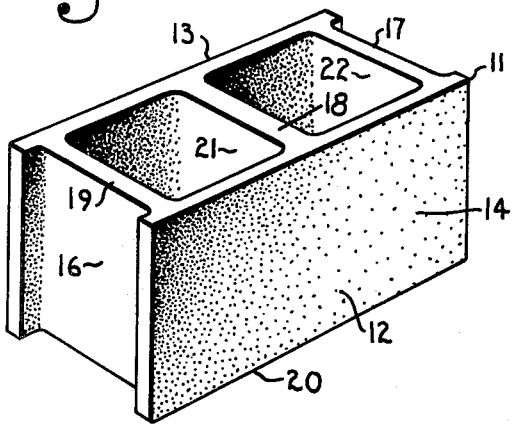
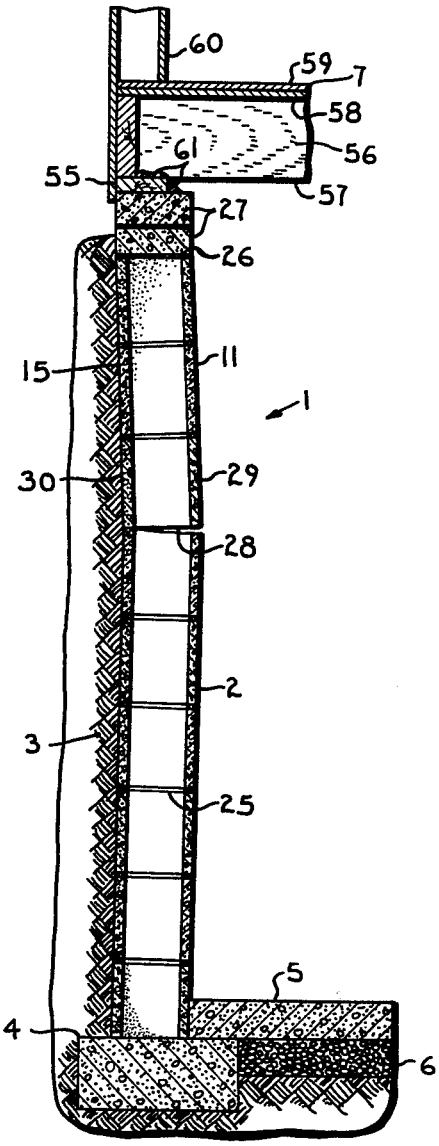
Fig. 2.
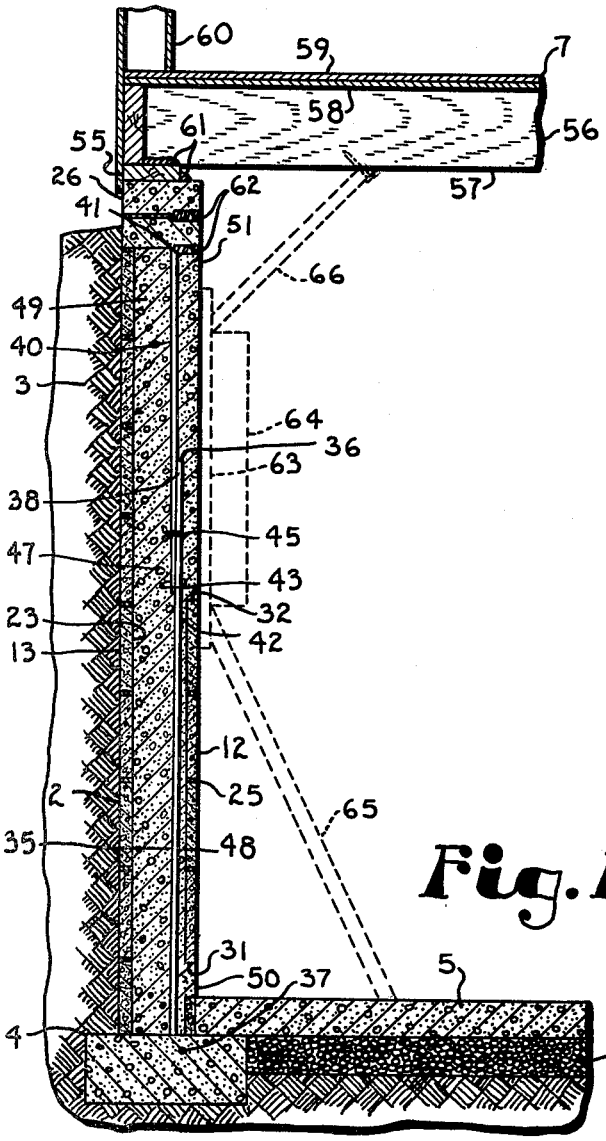
Fig. 1.

METHOD OF STRAIGHTENING AND REINFORCING STRUCTURAL MEMBERS

This invention relates to a method of straightening and reinforcing a structural member and more particularly, to a method of straightening and reinforcing a basement wall constructed of block members having aligned vertical passages.

BACKGROUND OF THE INVENTION

Below ground structural members are well-known in the field of construction and a variety of different designs have been developed in an attempt to achieve efficient and economical construction while maintaining structural integrity. Such structural members must be designed to resist lateral forces associated with the surrounding soil as well as downward forces associated with a structure resting thereon. Particularly severe lateral forces are often associated with hydrostatic pressure being exerted against the outside of such structural members. For example, during periods of heavy rainfall, water may be forced against an underground structural member under great pressure. Basements typically have soil against the outside of one or more walls and are thereby particularly threatened by such lateral forces. Under sufficient pressure, cracks will form in the basement walls and allow water to seep into the basement. Also, parts of the basement walls are often displaced inwardly by the pressure. Finally, if the deflection is allowed to continue unabated, an entire basement wall may buckle and collapse with resultant damage to the structure supported thereon.

It is well-known to use concrete blocks or cinder blocks for constructing basement walls. Although building codes currently in force in many jurisdictions prohibit such masonry block walls below ground, the practice is still followed in some areas. Consequently, many houses in existence today and some new housing have basement walls constructed of such masonry blocks. Although generally less expensive than equivalent poured concrete basement walls, masonry block walls are less resistant to lateral forces associated with the surrounding earth because the mortar joints binding the individual blocks are inherently weak in tension. A lateral force against the outside surface of a basement wall creates a compressive force component along the outside surface and a tensile force component along the inside wall surface. Therefore, as the mortor joints yield to the tensile force component, cracks appear between the masonry blocks on the inside wall surface.

One method of straightening walls may be seen in the Hevner U.S. Pat. No. 377,940. This method for redistributing the compressive forces in a wall includes using wedges to prevent further buckling. To practice such method however, requires that the outside of the wall below ground be exposed for placing the wedges. The Wertz U.S. Pat. No. 2,128,480 discloses a method of reconstructing concrete utilizing a concrete patch reinforced with a mesh network attached to the old concrete by tension anchor bolts but requires the removal of substantial portions of a wall surface to a depth sufficient to anchor the reinforcing mesh within the new concrete patch. A filling for and method of closing fractures in masonry walls is shown in the Walter U.S. Pat. No. 2,417,026. However, the material inserted into the cracks is yieldable to conform to further widening of the gaps and therefore would not bind the individual masonry units together sufficiently to resist additional separation.

Another heretofore common repair method involves replacement of the damaged masonry block walls. For a basement wall supporting a structure, the procedure usually involves raising the structure and placing temporary support posts thereunder. The earth adjacent the outer wall surface generally must be excavated to allow removal of the old masonry blocks and to allow a new wall to be constructed. Such excavation process typically results in large piles of dirt on the premises and damage to landscaping and shrubbery adjacent to the structure. The new basement walls are usually constructed with masonry blocks in the same manner as the old walls and therefore have the same inherent faults and are just as vulnerable to lateral hydrostatic pressure. This method of repair by constructing replacement masonry block walls not only leads to recurrences of the problems of leakage, displacement and eventual collapse, but is also time consuming and expensive.

The Johnson et al U.S. Pat. No. 4,189,891 shows a method for anchoring and straightening walls which includes digging a hole at some distance from the wall to be repaired. A threaded shaft is then inserted through the wall and the surrounding earth and into the hole where it is anchored in place. A wall plate is fitted over the end of the shaft extending through the basement wall and a nut is threaded thereon and tightened so that the wall plate is forced against the wall to thereby straighten and anchor the wall. However, there are several disadvantages to this method. First, the amount of force which can be exerted against the basement wall is limited by the condition of the surrounding soil which must securely anchor one end of the shaft. Secondly, exterior excavation is required to form the necessary outside holes. Finally, the wall plate and the end of the shaft and nut protrude inwardly from the basement wall. The owner of the structure may therefore have to construct another wall surface inwardly of the original basement wall to achieve a finished appearance.

SUMMARY AND OBJECTS OF THE INVENTION

In the practice of this method of repairing structural members such as basement walls constructed of masonry blocks, a determination is first made, based upon the extent of deflection and buckling, whether to straighten the wall or reinforce it in its existing condition. If deflection and buckling are sufficiently severe to require straightening, the adjacent earth is first thoroughly soaked for several days until it achieves a semi-fluid condition. The wall may then be pushed back to a straightened position by suitable jack means within the basement exerting lateral force against the wall inside surface. An opening is then made into one of the continuous passages defined by the vertically aligned passages of the individual masonry blocks. Reinforcing members are then inserted through an opening in the wall inside surface, connected and secured within the continuous passage by filling the passage and the opening with a grout material. When the grout material has sufficiently hardened, the jacking means, if used, may be removed leaving the basement wall relatively smooth and free of reinforcing extending inwardly therefrom into the basement. The reinforcing members within the basement wall will resist the tensile force component of the lateral forces associated with the surrounding earth mass.

The present invention provides an efficient method of repairing basement walls which is considerably more effective, less costly, and less time consuming than removing and replacing existing basement walls. Unlike other prior art methods, the entire process may be done from the inside of the basement without excavation of the adjacent earth and attendant damage to landscaping around the structure. The reinforcing members and the grout material are entirely contained within the confines of the original wall structure and consequently, no space within the basement is lost and no unsightly reinforcing protrusions are left to conceal.

The principal objects of the present inventon are: to provide an improved method of straightening and reinforcing a structural member; to provide such a method for reinforcing a structural member of masonry or similar construction; to provide a method of straightening and reinforcing basement walls comprised of masonry blocks; to provide such a method which includes securing a reinforcing member within aligned passages of individual masonry blocks; to provide such a method for reinforcing basement walls where the reinforcing member resists a tensile force component of a lateral force exerted against the outside of the basement wall by an earth mass; to provide such a method of repairing a basement wall which may be done from the inside of the basement; to provide such a method whereby a basement wall may be straightened and reinforced without excavation of the adjacent earth; to provide such a method of repairing a basement wall which may be done by unskilled labor; to provide such a method for straightening and reinforcing a structural member which is effective, yet efficient to perform and which permits a significant overall cost savings for the user in comparison with prior art methods; and to provide a straightened and reinforced wall which has a relatively smooth and even interior surface and will withstand greater lateral forces thereagainst than the same wall in a new or unreinforced state.

Other objects and advantages of this invention will become apparent from the following description taken in connection with the accompanying drawings wherein are set forth by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a cross-sectional view of a basement wall reinforced by the method of the present invention showing the placement of the reinforcing members within aligned passages of the masonry block units thereof.

FIG. 2 is a cross-sectional view of a basement wall which has been displaced inwardly by lateral forces associated with an adjacent earth mass.

FIG. 4 is an enlarged perspective view of a masonry block unit of the type used in constructing basement walls.

DESCRIPTION OF THE PREFERRED EMBODIMENT

Figure 3:
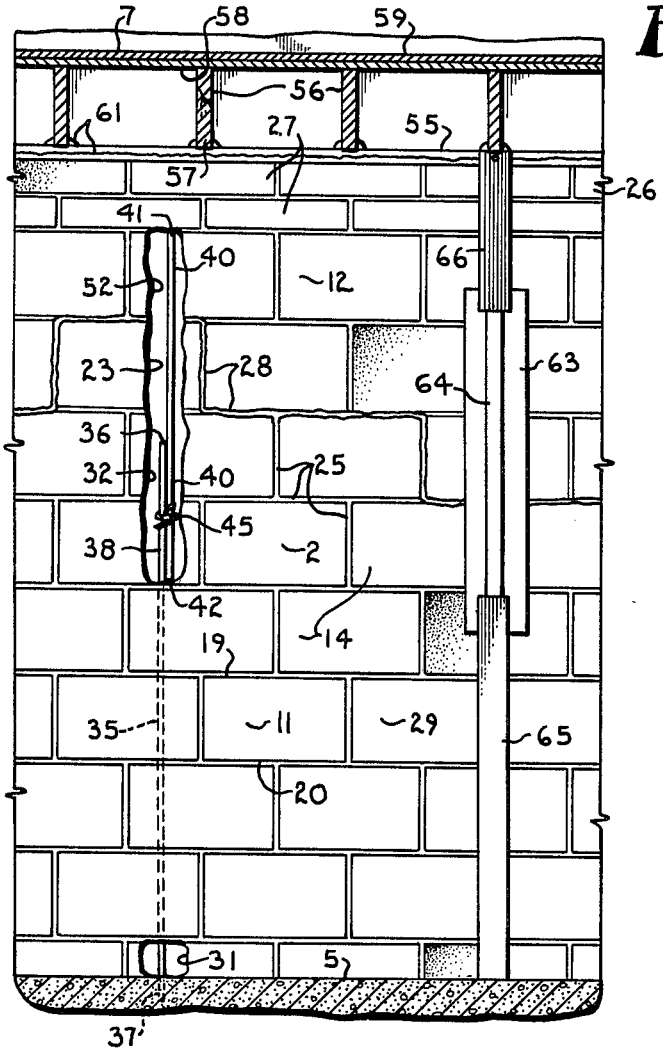
FIG. 3 is a partial elevational view of the basement wall showing the placement of reinforcing members at one location and a form board in place to retain grout material at another location.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates a basement structure including a wall 2 extending below ground with an earth mass 3 adjacent thereto. The basement wall 2 is supported by a concrete footing 4. A concrete slab 5 comprises the floor of the basement is supported primarily by a gravel bed 6 which facilitates drainage of water from beneath the slab 5. In the present embodiment of this method, a structure such as a residence is positioned over and supported by the basement. A floor structure 7 of typical construction is shown positioned on the basement wall 2.

The basement wall 2 is constructed of a plurality of masonry block units 11, commonly known as "concrete blocks" or "cinder blocks" as shown in FIG. 4. Each masonry block 11 includes an inner wall 12 and an outer wall 13 respectively displaying with respect to the basement wall 2 an inner face 14 and an outer face 15. The inner and outer walls 12 and 13 are connected by a left web 16, a right web 17 and a center web 18. Each masonry block 11 has a top 19 and a bottom 20 with left and right vertical passages 21 and 22 respectively extending therebetween.

Although the masonry block 11 as shown has two passages 21 and 22 extending therethrough, blocks with three or four passages are also well-known. Such blocks are formed with the desired number of passages being defined by a plurality of webs such as the center web 18 connecting the respective inner and outer walls 12 and 13 of the illustrated block 11. Solid masonry blocks which have no passages may also be encountered, but are usually present only in a few horizontal "courses" of an entire wall. The method of the present invention may be successfully employed with walls constructed of any of these types of masonry blocks.

In constructing the basement wall 2, masonry blocks 11 are stacked one upon the other with each row being staggered half the width of a block with respect to the rows above and below (FIG. 3). The left passage 21 of each masonry block 11 thereby aligns with the right passages 22 of respective blocks positioned above and below and vice versa. Continuous vertical passages 23 extending the entire height of the basement wall 2 are thereby defined. Similarly, blocks having more than two passages each are stacked in a staggered fashion whereby vertical passages extending the entire height of a wall constructed thereof are defined. As the masonry blocks 11 are stacked, they are joined by mortor joints 25 comprised primarily of mortar cement and sand. The motor joints 25, while capable of resisting compressive forces, are relatively ineffective in resisting tensile forces which tend to separate the individual masonry blocks 11. Therefore, masonry block walls are generally capable of supporting a structure and resisting the compressive force component of a lateral force, but are incapable of resisting the tensile force component associated with any significant lateral force. A cap 26 comprising two staggered rows of solid masonry blocks 27 may be positioned on top of the basement wall 2. The inner and outer wall surfaces 29 and 30 are respectively defined by the inner and outer faces 14 and 15 of the individual masonry blocks 11.

Figure 5:
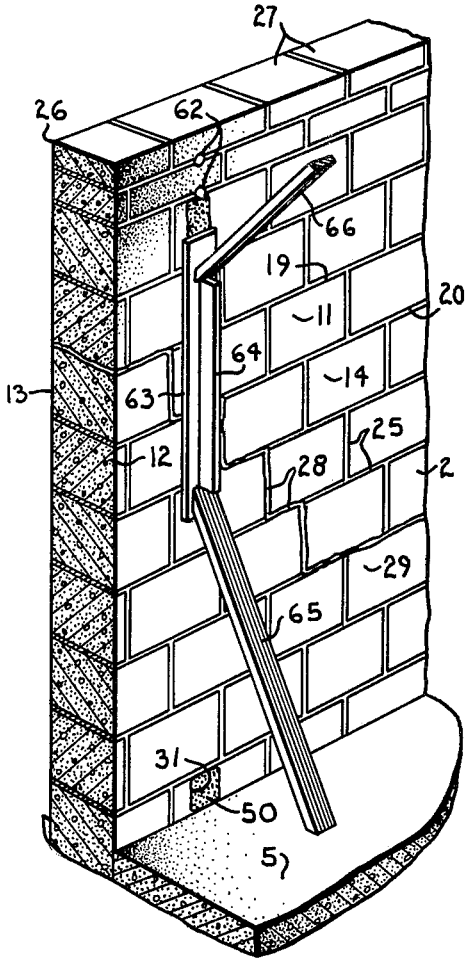
FIG. 5 is a fragmentary perspective view of a basement wall showing a form board secured thereto to retain the grout material.

A crack 28 is shown on the wall inner surface 29. Such cracks, which in basement walls are typically caused by a lateral force associated with an adjacent earth mass 3, occur at the mortar joints 25 which are the weakest parts of a basement wall 2. As shown in FIGS. 3 and 5, the cracks 28 often move diagonally across a wall inner surface 29 in a "stair step" fashion or horizontally about midway between the top and bottom of the wall 2 and follow the mortar joints 25. Cracks 28 in a basement wall 2 often admit water from the surrounding earth 3 under hydrostatic pressure which can result in flooding of the basement. Also, if timely corrective measures are not taken, the cracks 28 can continue to widen and may ultimately result in total collapse of the basement wall 2 with resultant damage to the residence or other overlying structure.

In the practice of the method of the present invention, a lower opening 31 is formed by removing a section of the inner wall 12 of a respective masonry block 11 adjacent the basement floor slab 5. The opening extends from the inner face 14 to either the left or right passage 21 or 22 of the respective masonry block 11. Access is thereby gained from the basement wall inner surface 29 to a respective vertical continuous passage 23 which extends the entire height of the basement wall 2. Interconnected sections of inner walls 12 of a plurality of vertically aligned masonry blocks 11 are then removed to form an upper opening 32 into the respective continuous passage 23 (FIG. 3). As the upper opening 32 is cut, for example, with a hammer and chisel, the resulting pieces of each block inner wall 12 and debris which are knocked into the respective continuous passage 23 may be removed through the lower opening 31. The respective continuous passage 23 is thereby accessible through both the lower and upper openings 31 and 32 from the inner basement wall surface 29. If a horizontal course of solid blocks is encountered, passages are cut where necessary to align with the continuous passages 23 defined by the passages 21 and 22 through the other blocks 11.

Steel reinforcing bars are a readily available building material and it has been found that two number 5 bars within continuous passages 23 spaced at approximately four feet on centers will provide sufficient reinforcement for most basement walls. Such reinforcing bars typically have a yield strength of approximately 60,000 pounds per square inch. A lower reinforcing bar 35 having upper and lower ends 36 and 37 is inserted through the upper opening 32 and into a lower part of the respective continuous passage 23. The lower reinforcing bar lower end 37 rests on the footing 4. An upper reinforcing bar 40 having an upper end 41, a lower end 42 and an overlapping portion 43 is then inserted through the upper opening 32 and its upper end 41 abutted against the cap 26 at the top of the basement wall 2 or against the floor structure 7 if there is no cap 26. Overlapping portions 38 and 43 respectively of the lower and upper reinforcing members 35 and 40 are positioned in generally aligned relation and connecting means 45, such as the twisted wire shown in FIGS. 1 and 3 is used to connect the overlapping portions 38 and 43. The reinforcing members 35 and 40 are positioned within the continuous passage 23 as near the inner walls 12 of the respective masonry blocks 11 as possible since the tensile component which the reinforcing members resist of a lateral force exerted against outer wall surface 30 will be concentrated on the inner wall surface 29.

Grout material 47 comprising cement or the like is placed within the passages 23 wherein the reinforcing bars 35 and 40 are placed so as to completely fill the passages 23. Suitable cement has a strength of approximately 3,000 pounds per square inch and secures the reinforcing members 35 and 40 within a respective continuous passage 23 and to surrounding masonry blocks 11. A lower pour 48 of grout material 47 enters the continuous passage 23 through the upper opening 32 until it can be observed at the lower opening 31 thereby indicating that the continuous passage 23 below the upper opening 32 is then completely filled by the lower reinforcing bar 35 and the lower pour 48. The reinforcing bars 35 and 40 which are accessible through the upper opening 32 are then grasped and agitated to insure a cohesive bond between the lower reinforcing bar 35 and the lower pour 48 of grout material 47.

A form member 63 is placed against the inner wall surface 29 to partially cover the upper opening 32, as shown in FIG. 3 and FIG. 5. Each form member 63 has a stiffener 64 attached thereto. A lower shore 65 extends from the form member 63 to the basement floor slab 5. An upper shore 66 is shown nailed to the stiffener 64 and to the underside of the floor structure 7 and works in conjunction with the lower shore 65 to hold the form member 63 against the basement wall inner surface 29. The form member 63 is adapted to retain an upper pour 49 of grout material 47 which enters the continuous passage 23 through the uncovered part of the upper opening 32 (shown adjacent the cap 26) until adequate time has elapsed for the cementous grout material 47 to cure. A lower patch 50 of grout material 47 is placed in the lower opening 31. An upper patch 51 is placed in that portion of the continuous passage 23 and the upper opening 32 above the level of the form member 63 remaining unfilled after the upper pour 49. The lower and upper patches 50 and 51 replace the sections of the masonry block inner walls 12 removed to create the lower and upper openings 31 and 32. After curing, the basement wall inner surface 29 thereby presents a smooth, finished appearance as the cementous grout material 47 used for the lower and upper patches 50 and 51 is similar in appearance to the material of the surrounding masonry blocks 11 which are typically comprised of concrete or concrete and cinders. After the grout material 47 has sufficiently hardened or solidified to be self supporting, the form members 63 and associated shoring may be removed.

This procedure is repeated at horizontal intervals of approximately every four feet along each wall to reinforce an entire basement. It has been roughly calculated that a typical masonry block basement wall reinforced according the method of the present invention with number 5 reinforcing bars (60,000 P.S.I. yield strength) secured within passages spaced horizontally every four feet with 3,000 P.S.I. cement is capable of retaining soil with an equivalent fluid pressure of 30 pounds per cubic foot. This soil retention capacity far exceeds that of original unreinforced masonry block construction and further should exceed the capacity required to resist any lateral force likely to be encountered during the life of the structure.

The basement wall 2 may be secured to the floor structure 7 as an optional step of this invention. The floor structure 7, as shown in FIGS. 1 and 2 comprises a sill plate 55 positioned on the cap 26, a plurality of horizontal joists 56 with bottoms 57 positioned on the sill plate 55 and tops 58, and flooring 59 for the overlying structure positioned on the joist tops 58. A wall 60 of conventional frame-type construction extends upwardly from the flooring 59. To secure the floor structure 7 to the basement wall 2, two receivers 62 are drilled above each reinforced position, one receiver 62 into each of the mortar joints 25 between the two rows of solid blocks 27 comprising the cap 26 and the other receiver 62 into the mortar joint 25 between each respective bottom cap block 27 and top masonry block 11 (FIG. 1). The receivers 62 have greater diameters than the widths of the mortar joints 25 and therefore penetrate part of the adjacent blocks. Epoxy-type adhesive 61 is then injected into each receiver 62 so as to securely bond the cap 26 to the basement wall 2. A continuous bead of adhesive 61 is then applied along mating edges of the cap 26, or the uppermost horizontal course of blocks 11 if there is no cap, and the sill plate 55 to create an adhesive bond therebetween. Adhesive 61 is also applied to the interface of the sill plate 55 and the joists 56. The basement wall 2 is thereby securely attached to the floor structure 7 and is prevented from being displaced inwardly by a lateral force associated with the adjacent earth mass 3. In particular after the basement wall 2 is reinforced, greater lateral forces are anticipated at the interconnections between the basement wall 2 and the cap 26, between the cap 26 and the sill plate 55 and between the sill plate 55 and the joists 56 because the reinforced wall, with its greater capacity for resisting a lateral hydrostatic force, will no longer crack and buckle but instead will transfer a part of such a force to such interconnections and to the floor structure 7. By securely bonding the floor structure 7 thereto, the basement wall 2 is prevented from being displaced with respect to the overlying structure by the lateral forces acting against the wall outer surface 30.

Figure 6:
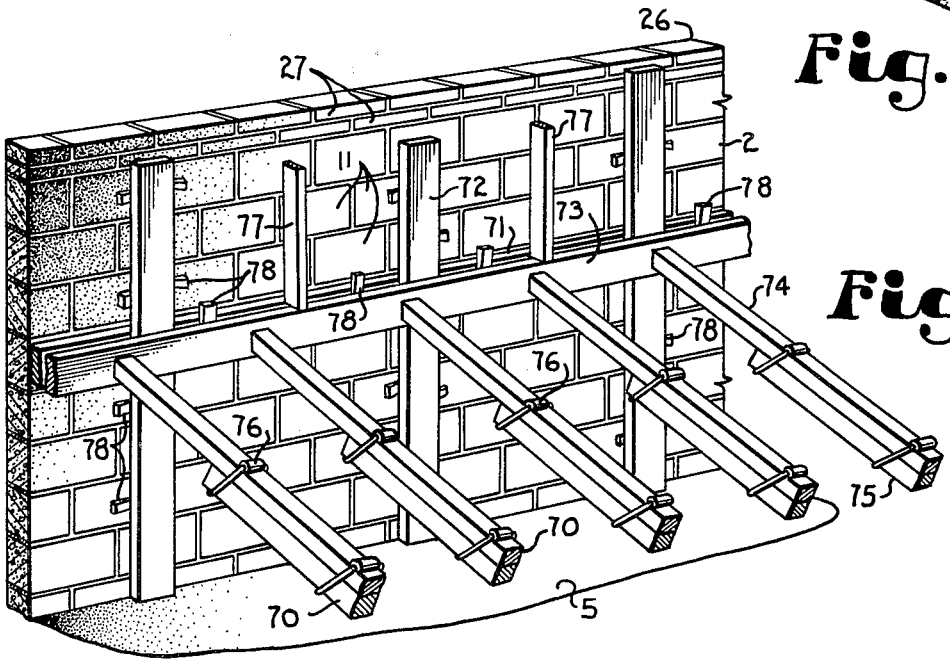
FIG. 6 is a fragmentary perspective view showing jacking means in place for the step of straightening the masonry block wall displaced inwardly by a lateral force associated with the adjacent earth mass.

A further optional step of straightening an inwardly deflected basement wall 2 is shown in FIG. 6. When utilized, this optional step is normally first or at least before the grout 47 is placed in the passages 23. Hydrostatic pressure acting laterally against the wall outside surface 30 may, over a period of time, severely deflect the wall inwardly or even cause buckling. If such a deflected wall is allowed to continue to bow inwardly, the weight of the overlying structure will tend to accelerate the deflection process. A critical condition will be reached when the deformed wall is no longer capable of supporting the overlying structure and resisting the lateral hydrostatic pressure. Under such conditions the basement wall 2 may actually collapse inwardly. To reverse such a process, the basement wall 2 may have to be pushed back toward its original position. The adjacent earth 3 is first thoroughly permeated with water until it reaches a semi-fluid and more yieldable condition. The deformed wall 2 may then be more easily pushed back with ellis-type jacks 70 (FIG. 6). A first horizontal member 71 is placed against that portion of the wall inner surface 29 most deflected inwardly. Upright members 72 are then placed against the first horizontal member 71 at spaced intervals and are connected by a second horizontal member 73 generally horizontally spaced from the member 71. The second horizontal member 73 is prevented from sliding upward under force by the braces 77 which are secured to the floor joists 56.

Each ellis jack 70 is comprised of a first longitudinal member 74 having an end in abutting engagement against the second horizontal member 73 and a second longitudinal member 75. The second longitudinal members 75, for example, may engage corresponding ellis jacks exerting force against an opposite basement wall in opposed relation to the ellis jacks 70. Alternatively, the second longitudinal members 75 may be attached to the basement floor structure itself by suitable attaching means. The ellis jack first and second longitudinal members 74 and 75 are rigidly connected by connecting bands 76 which allow the first and second longitudinal members to slide with respect to each other in one direction only. Extension of the ellis jack 70 is caused by jack means (not shown) and a lateral force is thereby exerted against the second horizontal member 73.

A plurality of wedge-shaped shins 78 are positioned between the horizontal members 71 and 73 and between the uprights 72 and the inner basement wall surface 29. The shims 78 distribute the force from the ellis jacks 70 and evenly distribute the outward pressure over the basement inner wall surface 29. After the basement wall 2 has been sufficiently moved to a straightened position, the wall 2 may be reinforced according to the method of the present invention as described herein. Normally, when the wall 2 is in the straightened position thereof, the inner wall surface 29 will be relatively flat and vertically aligned. The ellis jacks 70 may remain in position to retain the wall for approximately seventy-two hours after the reinforcement process is completed so that the grout material 47 may sufficiently harden. It is foreseen that a variety of jacking means and methods of distributing the resultant forces may be successfully employed with the present invention.

While the reinforcement of a masonry block basement wall has been disclosed, it will be appreciated that reinforcement of a variety of structural members may be accomplished using the method of the present invention. For example, basement walls constructed of clay tile or other materials could also be reinforced in a similar manner to resist lateral forces associated with an adjacent earth mass. Also, other structural members constructed of masonry blocks may be reinforced according to the method of the present invention, such as columns, posts, or slabs. Masonry blocks are a common building material for above-ground structures as well as for basements. Reinforcing would also strengthen such structures against lateral forces associated with, for example, the wind. Generally, all concrete and masonry-type building materials are relatively strong in compression and weak in tension. Steel, on the other hand, has relatively high tensile and compressive strength. Therefore, applicant's invention is particularly well adapted for reinforcing any existing concrete or masonry structural member against both the tensile and compressive force components associated with a lateral force.

It is to be understood that while certain forms of the present invention have been illustrated and described herein, it is not to be limited thereto except insofar as such limitations are included in the following claims.

What is claimed and desired to secure by Letters Patent is:

1. A method of reinforcing a structural member including an upper and lower block member, each of said block members having an inner wall in spaced relation to an outer wall with a passage being defined therebetween, said passages of said upper and said lower block members being substantially aligned and each of said first and said second block member inner walls having a face comprising a part of a surface of said structural member, said method comprising the steps of:

(a) removing a section of said inner wall of one of said block members whereby an opening is formed from said structural member surface to said one block member passage;

(b) placing a lower reinforcing member having an upper end through said opening and into said lower block member passage;

(c) placing an upper reinforcing member having a lower end through said opening and into said upper block member passage;

(d) connecting said upper end of said lower reinforcing member and said lower end of said upper reinforcing member; and (e) securing said upper and said lower reinforcing members to said upper and said lower block members respectively.

2. The method as set forth in claim 1 which includes the steps of:

(a) placing a first quantity of grout within said lower block member passage whereby said lower reinforcing member is secured to said lower block member;

(b) removably attaching a form member to said structural member surface whereby said opening is partially covered;

(c) placing a second quantity of grout material within said upper block member passage whereby said upper reinforcing member is secured to said upper block member, said second quantity of grout material being retained within said upper block member passage by said form member until said grout material has hardened sufficiently to be self retaining within said passage; and (d) removing said form member.

3. The method as set forth in claim 1 wherein said opening is from said structural member surface to said upper block member passage and is formed by removing a section of said inner wall of said upper block member, said method further comprising the steps of:

(a) removing a section of said inner portion of said lower block member whereby a lower opening is formed from said wall surface to said lower block member passage; and (b) placing said first quantity of grout through said opening and into said upper block member passage whereby said first quantity of grout may be observed through said lower opening.

4. The method as set forth in claim 1 including the step of:

(a) exerting a lateral force against said structural member whereby said structural member is urged into a straightened position.

5. The method as set forth in claim 4 wherein said structural member comprises a below-ground wall with a quantity of earth adjacent said below-ground wall, said method including the step of:

(a) increasing the flowability of said quantity of earth to facilitate moving said below-ground wall to a straightened position.

6. The method as set forth in claim 1 wherein:

(a) said structural member is a first structural member; and including:

(b) a second structural member supported on said first structural member; said method including the step of:

(c) fixedly securing said first structural member to said second structural member supported thereon.

7. A method of straightening and reinforcing a first structural member including an upper and a lower block member, each of said block members having an inner wall in spaced relation to an outer wall whereby a passage is defined therebetween, each of said block member inner walls having a face comprising a part of a surface of said first structural member and said walls supporting a second structural member thereon, said method comprising the steps of:

(a) exerting a force against said first structural member surface whereby said first structural member is moved to a straightened position with said passages being substantially vertically aligned;

(b) removing a section of said inner wall of said upper block member whereby an upper opening is formed from said first structural member surface into said upper block member passage;

(c) removing a section of said inner wall of said lower block member whereby a lower opening is formed from said first structural member surface into said lower block member passage;

(d) placing a lower reinforcing member having an upper end through one of said openings and into said lower block member passage;

(e) placing an upper reinforcing member having a lower end through one of said openings and into said upper block member passage;

(f) connecting said upper end of said lower reinforcing member and said lower end of said upper reinforcing member;

(g) placing a first quantity of a grout material into said lower block member passage whereby said lower reinforcing member is secured to said lower block member;

(h) removably attaching a form member to said first structural member surface whereby said upper opening is partially covered, said form member being adapted for retaining a second quantity of grout material within said upper block member passage;

(i) placing said second quantity of grout material within said upper block member passage whereby said upper reinforcing member is secured to said upper block member; and (j) securing said first structural member to said second structural member supported thereon.

8. The method as set forth in claim 7 which includes the step of:

(a) placing said first quantity of grout material through said upper opening and into said lower block member passage whereby said grout material is visible through said lower opening.

9. The method as set forth in claim 7 wherein said second structural member comprises:

(a) a floor structure including a plate member positioned on said first structural member and a joist member positioned on said plate member and extending perpendicularly in a horizontal direction therefrom; said method including the steps of:

(1) securing said plate member to said first structural member with an adhesive material; and (2) securing said joist to said plate with an adhesive material.

10. The method as set forth in claim 7 wherein said first structural member extends below the ground and has a quantity of earth adjacent thereto opposite said surface, said method including the step of:

(a) impregnating said quantity of earth with a liquid to facilitate moving said first structural member to a straightened position.

11. The method as set forth in claim 7 which includes the step of:

(a) exerting said force against said first structural member surface by a jack, said jack including a first and a second longitudinal member, said longitudinal members being slidably attached.

12. A method of straightening and reinforcing an existing structural member comprising the steps of:

(a) applying a lateral force against a surface of said structural member until said structural member is in a straightened position wherein a surface thereof is substantially flat;

(b) forming an elongated passage in said structural member, said passage being open from said surface of said structural member;

(c) placing a reinforcing member within said passage; and (d) securing said reinforcing member to said structural member within said passage whereby said reinforcing member maintains said structural member in the straightened position thereof after said force is removed from said structural member.

13. A method of reinforcing an existing structural member having a passage within said structural member, said method comprising the steps of:

(a) removing a section of said structural member whereby an opening is formed into said passage;

(b) placing a reinforcing member within said passage;

(c) securing said reinforcing member to said structural member; and (d) exerting a lateral force against a face of said structural member whereby said structural member is moved into a straightened position.

* * * * *